US006650097B2

(12) United States Patent
Sakurai

(10) Patent No.: US 6,650,097 B2
(45) Date of Patent: Nov. 18, 2003

(54) VOLTAGE REGULATOR WITH REDUCED POWER LOSS

(75) Inventor: Atsushi Sakurai, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 10/164,058

(22) Filed: Jun. 6, 2002

(65) Prior Publication Data

US 2003/0001549 A1 Jan. 2, 2003

(30) Foreign Application Priority Data

Jun. 8, 2001 (JP) ..... 2001-174039

(51) Int. Cl.[7] ..... G05F 1/56
(52) U.S. Cl. ..... 323/279; 323/281; 323/907
(58) Field of Search ..... 323/276, 279, 323/281, 907

(56) References Cited

U.S. PATENT DOCUMENTS 4,146,903 A * 3/1979 Dobkin ..... 357/28
4,298,835 A * 11/1981 Rowe ..... 323/281
4,587,476 A * 5/1986 Cushman ..... 323/276
4,800,331 A * 1/1989 Vesce et al. ..... 323/279
5,621,306 A * 4/1997 Ise ..... 323/907
6,300,749 B1 * 10/2001 Castelli et al. ..... 323/276

* cited by examiner

*Primary Examiner*—Jeffrey Sterrett
(74) *Attorney, Agent, or Firm*—Adams & Wilks

(57) ABSTRACT

To provide a voltage regulator with high safety in which its characteristics do not deteriorate and the regulator is not destroyed even if it is used with a large loss, for example, it is erroneously used in excess of an allowable loss. The voltage regulator of the present invention is provided with a loss detecting circuit that functions so as to lower an output voltage when a loss increases. When the loss detecting circuit is activated, the output voltage falls and an output current decreases, whereby the loss can be reduced.

7 Claims, 2 Drawing Sheets

VOLTAGE REGULATOR WITH REDUCED POWER LOSS

BACKGROUND OF THE INVENTION

1. Field of the Invention

The present invention relates to a voltage regulator.

2. Description of the Related Art

A conventional voltage regulator will be described with reference to FIG. 2.

FIG. 2 is a circuit block diagram showing an example of a configuration of the conventional voltage regulator.

As shown in FIG. 2, a voltage regulator 201, which is provided with external terminals, namely, an input voltage terminal 102, a GND terminal 103 and an output voltage terminal 104, is constituted by a reference voltage circuit 105 capable of outputting a constant voltage, a voltage dividing circuit 106 capable of dividing in an appropriate proportion a voltage of the output voltage terminal 104, an error amplifier circuit 107 capable of comparing two input voltages to adjust an output voltage, and an output circuit 108 capable of adjusting an impedance.

The error amplifier circuit 107 causes the output circuit 108 to adjust an impedance such that an input voltage from the voltage dividing circuit 106 is kept equal to an output voltage of the reference voltage circuit 105. Therefore, the voltage regulator 201 can keep a voltage of the output voltage terminal 104 constant even if an input voltage fluctuates.

In FIG. 2, the voltage dividing circuit 106 is constituted by resistors, and the output circuit 108 is constituted by an enhancement PMOS transistor. Various external loads such as a CPU and a microcomputer are connected to the output voltage terminal 104 according to an application of the voltage regulator 201. The voltage regulator 201 generates in the output circuit 108 a loss represented by the following expression (1).

$$Pt=(V\text{in}-V\text{out})\times I\text{out} \quad (1)$$

Where Pt is a loss (W), Vin is an input voltage (V), Vout is an output voltage (V) and Iout is an output current (A).

When the input voltage is high and the output current is large (an impedance of an external load is low), the loss increases. Usually, an allowable loss is defined for a plastic package or the like in which a voltage regulator is implemented and a user sets conditions of use not to exceed the allowable loss. Most of the loss is generated in the form of heat.

However, in the conventional voltage regulator, if it is erroneously used in excess of an allowable loss, there are problems that characteristics of the voltage regulator are deteriorated and the regulator may be destroyed by generated heat. Thus, a user is required to a measurement for heat radiation and safety in order to cope with a case of the voltage regulator being erroneously used in excess of an allowable loss.

SUMMARY OF THE INVENTION

In order to solve the above-described problems, a voltage regulator of the present invention is provided with means for detecting a loss, with which the voltage regulator can detect an increase in a loss to automatically enter a protective operation and reduce the loss.

The voltage regulator of the present invention is provided with a loss detecting circuit that functions so as to lower an output voltage when a loss has increased. When the loss detecting circuit is activated, the output voltage falls to decrease an output current, reducing the loss. As a result, an automatic protective function against an excessive loss is added to the voltage regulator, whereby a voltage regulator with high safety can be realized in which its characteristics are not deteriorated and the regulator is not destroyed even if conditions of use are erroneously set.

According to the present invention, there is provided a voltage regulator comprising:

- an error amplifier circuit that receives an output from a reference voltage generation circuit as one input;
- an output circuit that is controlled by an output of the error amplifier circuit;
- a voltage dividing circuit that is connected to the output circuit in series, the error amplifier circuit receiving a divided voltage from the voltage dividing circuit as the other input;
- a first loss detecting circuit that is connected between the one input of the error amplifier circuit and a GND terminal; and
- a second loss detecting circuit that is connected between an input voltage terminal of the output circuit and an output terminal of the error amplifier circuit.

Here, as the loss detecting circuit, there may be used a temperature detecting circuit in which a gate and a source of an enhancement PMOS transistor are electrically connected or a temperature detecting circuit in which a gate and a source of an enhancement NMOS transistor are electrically connected.

DETAILED DESCRIPTION OF THE PREFERRED EMBODIMENTS

Embodiments of the present invention will be hereinafter described with reference to the drawings.

Figure 1:
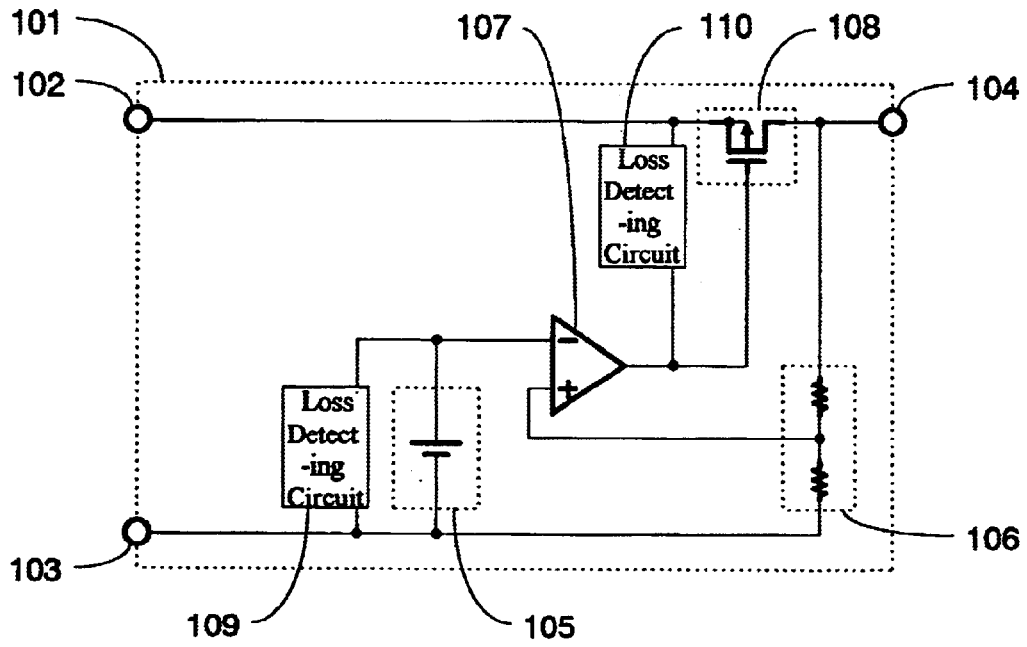
FIG. 1 is a circuit block diagram showing an example of a configuration of a voltage regulator of the present invention.

FIG. 1 is a circuit block diagram showing an example of a configuration of a voltage regulator of the present invention.

Figure 2:
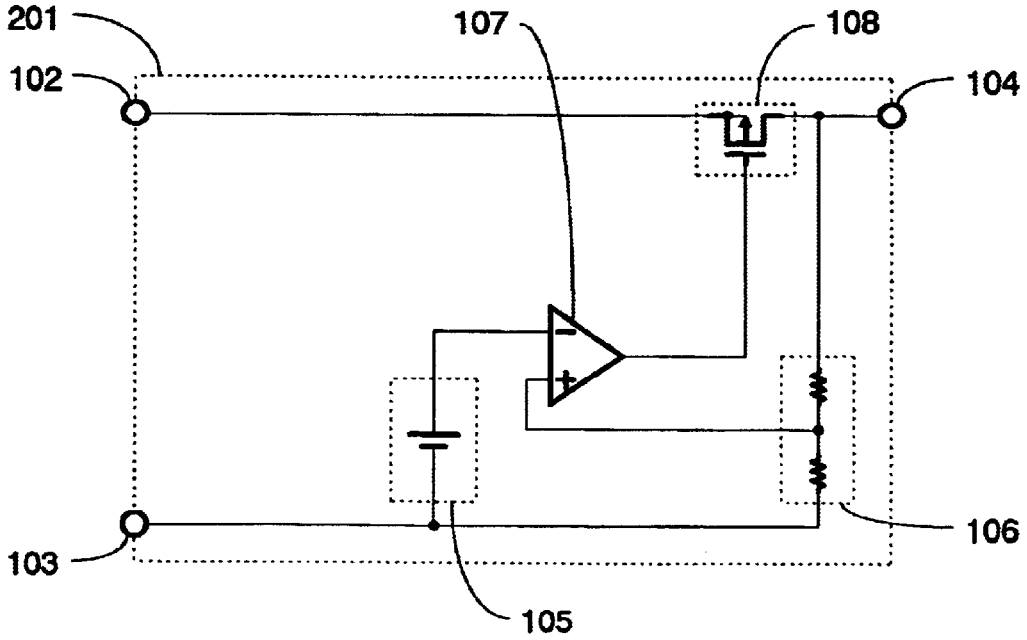
FIG. 2 PRIOR ART
FIG. 2 is a circuit block diagram showing an example of a configuration of a conventional voltage regulator.

A voltage regulator 101 is provided with a loss detecting circuit 109 between an input terminal of an error amplifier circuit 107, to which a reference voltage generated by a reference voltage circuit 105 is inputted, and a GND terminal 103. In addition, a loss detecting circuit 110 is provided between an output terminal of the error amplifier circuit 107 and an input voltage terminal 102. Other parts of the voltage regulator 101 are the same as those shown in FIG. 2.

In the voltage regulator 101 that outputs a constant voltage, the loss detecting circuit 109 and the loss detecting circuit 110 are set to monitor a loss of an output circuit 108 and to respectively have a decreased impedance only when the loss exceeds a fixed value. When the impedance of the loss detecting circuit 109 decreases, a reference voltage is pulled down to be closer to a potential of the GND terminal 103. Thus, an output voltage of the error amplifier circuit 107 increases, and the voltage regulator 101 applies feedback in a direction in which an output voltage of the output voltage terminal 104 is decreased. In addition, when the impedance of the loss detecting circuit 110 decreases, since an output of the error amplifier circuit 107 is pulled up to be closer to a potential of the input voltage terminal 102, an output voltage of the output voltage terminal 104 also falls. Here, since an output current is represented by the following expression, the output current decreases when the output voltage falls. From the above expression (1), it is seen that a loss becomes small when the output current decreases.

$$Iout=Vout/Rout \quad (2)$$

Where Vout is an output voltage (V), Iout is an output current (A) and Rout is an external load (Ω).

In addition, the loss detecting circuit 109 and the loss detecting circuit 110 are set to monitor a loss of the output circuit 108 and to respectively have a sufficiently increased impedance when the loss becomes smaller than a fixed value. Therefore, when the loss becomes small, the voltage regulator 101 of the present invention returns to a state in which it can output a constant voltage again. In this way, since the voltage regulator 101 is added with the automatic protective function against an excessive loss, a voltage regulator with high safety can be realized in which its characteristics do not deteriorate and the regulator is not destroyed even if conditions of use are erroneously established.

Here, the loss detecting circuit 109 and the loss detecting circuit 110 can freely set an amount of loss to be detected according to a use application. In addition, the above-described effects can be obtained even if only one of the loss detecting circuit 109 and the loss detecting circuit 110 is provided. Further, the loss detecting circuits may be provided in any place and may have any circuit configuration as long as they can detect a loss and lower an output voltage.

Figure 3:
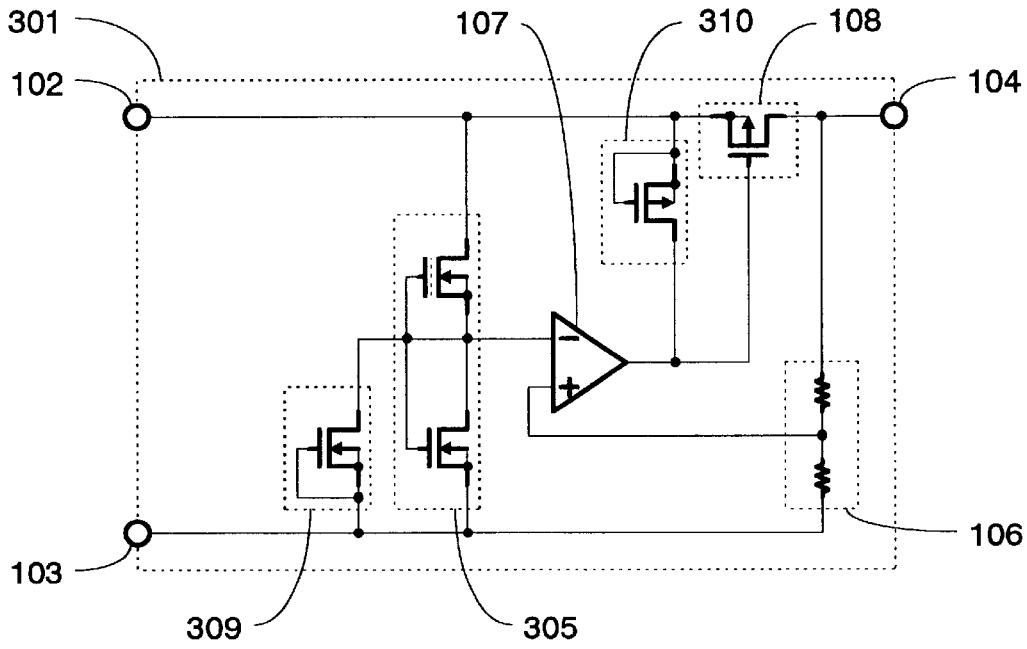
FIG. 3 is a circuit block diagram showing another example of a configuration of the voltage regulator of the present invention.

FIG. 3 is a block diagram showing another example of a configuration of a voltage regulator of the present invention.

A voltage regulator 301 is provided with a reference voltage circuit 305 as shown in JP 04-065546 B instead of the reference voltage circuit 105. The reference voltage circuit 305 has a depression NMOS transistor and an enhancement NMOS transistor arranged in series and outputs a constant voltage. In the reference voltage circuit 305, base terminals of the depression NMOS transistor and the enhancement NMOS transistor are electrically connected with source terminals of them, respectively. However, potentials of the base terminals can be set to other potentials. For example, the base terminal of the depression NMOS transistor may be electrically connected to have a potential of the GND terminal 103. In addition, a temperature detecting circuit 309 is provided as an example of the loss detecting circuit 109. The temperature detecting circuit 309 uses an enhancement NMOS transistor and is set to electrically connect a gate and a source to be turned off. In addition, a temperature detecting circuit 310 is provided as an example of the loss detecting circuit 110. The temperature detecting circuit 310 uses an enhancement PMOS transistor and is set to electrically connect a gate and a source to be turned off. Other parts of the voltage regulator 301 are the same as those shown in FIG. 1.

The temperature detecting circuit 309 and the temperature detecting circuit 310 are set to be usually in an off state and have a sufficiently large impedance. However, these circuits monitor heat generation due to a loss of the output circuit 108 and are set to have a small impedance utilizing heal leakage only when a temperature exceeds a fixed value. Therefore, since the temperature detecting circuit 309 and the temperature detecting circuit 310 have the same functions as the loss detecting circuit 109 and the loss detecting circuit 110, the voltage regulator 301 can obtain the same effects as the voltage regulator 101.

The temperature detecting circuit 309 and the temperature detecting circuit 310 can easily adjust a temperature at which an impedance decreases by adjusting characteristics of a transistor such as its size and a dosage of impurities. Consequently, since an output voltage falls when the temperature reaches a desired temperature and an automatic protective function against overheating is added to the voltage regulator 301, a voltage regulator with high safety can be realized in which its characteristics are not deteriorated and the regulator is not destroyed even if conditions of use are erroneously chosen.

In addition, when using a circuit such as the reference voltage circuit 305, the enhancement NMOS transistor in the reference voltage circuit 305 and the enhancement NMOS transistor in the temperature detecting circuit 309 may be constituted by transistors of the identical type. However, if sizes of both the transistors are adjusted and the enhancement NMOS transistor of the temperature detecting circuit 309 is set to cause heat leakage earlier, an overheat protective operation can be easily realized. In addition, although an impedance of the reference voltage circuit 305 is determined by a size of the depression NMOS transistor, the impedance is high in practice and only a current in the order of several μA is flowing at most. Therefore, in detecting a temperature, it is sufficient that the temperature detecting circuit 309 has an impedance lower than that of the reference voltage circuit 305, which can be easily realized if a heat leakage characteristic of the enhancement NMOS transistor is adjusted.

It is needless to mention that the temperature detecting circuit 309 and the temperature detecting circuit 310 can freely set a temperature to be detected according to a use application. In addition, the above-described effects can be obtained even if only one of the temperature detecting circuit 309 and the temperature detecting circuit 310 is provided. Further, the temperature detecting circuits may be provided in any place and may have any circuit configuration as long as they can detect a loss and lower an output voltage. For example, diodes in a reverse bias direction in which a current does not flow may be arranged, respectively, instead of the temperature detecting circuit 309 and the temperature detecting circuit 310 to utilize a heat leakage characteristic of the diodes or a temperature sensor.

Figure 4:
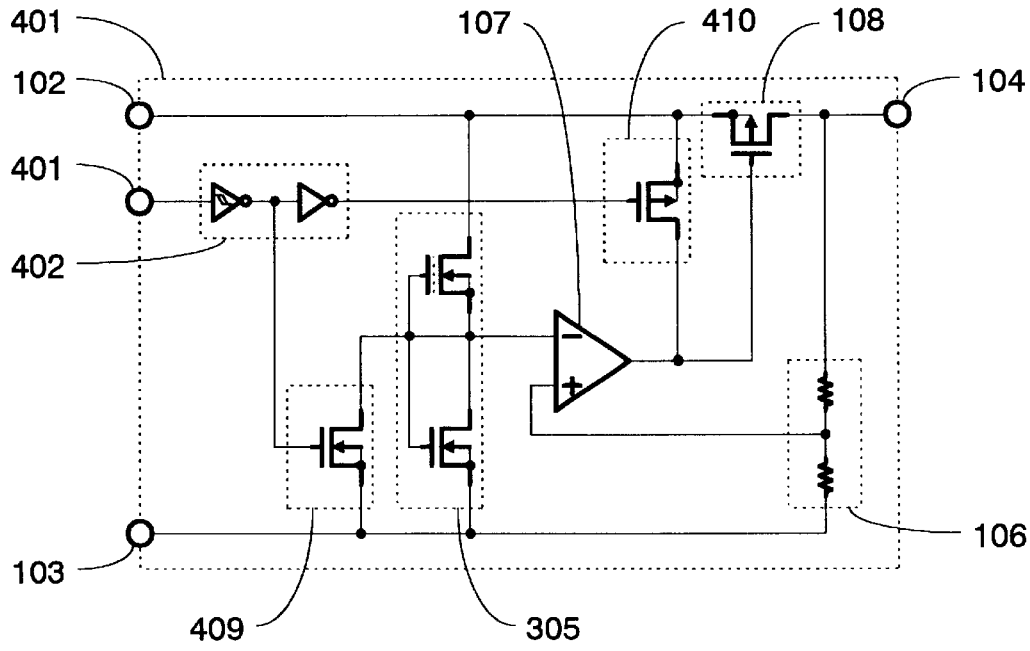
FIG. 4 is a circuit block diagram showing still another example of a configuration of the voltage regulator of the present invention.

FIG. 4 is a circuit block diagram showing still another example of a configuration of the voltage regulator of the present invention.

A voltage regulator 401 is further provided with an ON/OFF terminal 401 and a logic circuit 402, which are external terminals. The logic circuit 402 is constituted by an inverter having hysteresis and an inverter. In addition, a temperature detecting circuit 409 is provided instead of the temperature detecting circuit 309. The temperature detecting circuit 409 is the same as the temperature detecting circuit 309 except that its gate is connected to an output of the inverter having hysteresis of the logic circuit 402. Further, a temperature detecting circuit 410 is provided instead of the temperature detecting circuit 310. The temperature detecting circuit 410 is the same as the temperature detecting circuit 310 except that its gate is connected to the output of an output of the inverter of the logic circuit 402. Other parts of the voltage regulator 101 are the same as those shown in FIG. 2.

That is, the voltage regulator 401 has an ON/OFF function in addition to the functions of the voltage regulator 301. When the ON/OFF terminal 401 is set to a potential of the input voltage terminal 102 (hereinafter referred to as Hi), the gate of the temperature detecting circuit 409 assumes a potential of the GND terminal 103 (hereinafter referred to as Lo) and the enhancement NMOS transistor of the temperature detecting circuit 409 is turned off to increase an impedance. In addition, the gate of the temperature detecting circuit 410 assumes the potential Hi and the enhancement PMOS transistor of the temperature detecting circuit 410 is turned off to increase an impedance. Thus, the regulator is turned on to output a constant voltage. On the other hand, when the ON/OFF terminal is set to the potential Lo, the gate of the temperature detecting circuit 409 assumes the potential Hi and the enhancement NMOS transistor of the temperature detecting circuit 409 is turned on to decrease an impedance. Further, the gate of the temperature detecting circuit 410 assumes the potential Lo and the enhancement PMOS transistor of the temperature detecting circuit 410 is turned on to decrease an impedance. Thus, the regulator is turned off.

Here, while the regulator is in an on state, the temperature detecting circuit 409 and the temperature detecting circuit 410 have sufficiently high impedances and are in completely the same states as the temperature detecting circuit 309 and the temperature detecting circuit 310. Since the heat leakage characteristic is the same as a matter of course, the voltage regulator 410 can obtain the same effects as the voltage regulator 301.

As described above, the present invention utilizes the circuit configuration of the ON/OFF function and the automatic protective function against overheating is added thereto without increasing the number of a circuit. Therefore, a voltage regulator with high safety can be realized without increasing costs, in which its characteristics are not deteriorated and the regulator is not destroyed even if conditions of use are erroneously set.

In addition, since the present invention employs a protective system for detecting a loss, an amount of current that can be outputted varies according to an input voltage to the voltage regulator. That is, from the expression (1), it is seen that more current can be outputted until a loss reaches a certain level if the voltage regulator is used in an area where an input/output voltage difference is small. The present invention is clearly different from, for example, a protective system for detecting only a constant overcurrent and is more practical in this respect.

Further, although the embodiments have been described with a CMOS transistor circuit as an example, it is obvious that the present invention can be applied to a bipolar transistor circuit and other circuit forms as well, and is not limited by the embodiments by any means.

In the voltage regulator the present invention, there is provided the loss detecting circuit that functions so as to lower an output voltage if a loss has increased, obtaining the effect that a voltage regulator with high safety can be realized in which its characteristics do not deteriorate and the regulator is not destroyed even if it is erroneously used in excess of an allowable loss. In addition, there is another effect that the heat radiation measure and the safety measure required of a user can be reduced.

Thus, it is seen that a voltage regulator is provided. One skilled in the art will appreciate that the present invention can be practiced by other than the preferred embodiments which are presented for the purposes of illustration and not of limitation, and the present invention is limited only by the claims which follow.

What is claimed is:

1. A voltage regulator comprising:

an error amplifier circuit that receives an output from a reference voltage generation circuit as one input;

an output circuit that is controlled by an output of the error amplifier circuit;

a voltage dividing circuit that is connected to the output circuit in series, the error amplifier circuit receiving a divided voltage from the voltage dividing circuit as the other input; and a first loss detecting circuit that is connected between the one input of the error amplifier circuit and a GND terminal.

2. A voltage regulator according to claim 1, further comprising a second loss detecting circuit that is connected between an input voltage terminal of the output circuit and an output terminal of the error amplifier circuit.

3. A voltage regulator according to claim 2, the first loss detecting circuit and the second loss detecting circuit monitoring heat generated by a loss that is a product of a voltage difference between an input terminal and an output terminal and an output current, wherein an output voltage is lowered when a temperature exceeds an arbitrary value.

4. A voltage regulator according to claim 3, wherein the first loss detecting circuit and the second loss detecting circuit are provided with a function for decreasing an impedance when said temperature exceeds an arbitrary value.

5. A voltage regulator according to claim 4, wherein the first loss detecting circuit and the second loss detecting circuit for monitoring heat are a temperature sensor.

6. A voltage regulator according to claim 4, wherein the function for decreasing an impedance when the temperature exceeds an arbitrary value utilizes a heat leakage characteristic of a semiconductor element.

7. A voltage regulator comprising a detecting circuit for monitoring a loss that is a product of a voltage difference between an input terminal and an output terminal and an output current, wherein an output voltage is lowered when an amount of loss exceeds an arbitrary value.

* * * * *